US007881639B2

(12) United States Patent
Lioy

(10) Patent No.: US 7,881,639 B2
(45) Date of Patent: Feb. 1, 2011

(54) DEVELOPER UNITS, ELECTROPHOTOGRAPHIC APPARATUSES AND METHODS OF SUPPLYING DEVELOPER MATERIAL TO PHOTOCONDUCTIVE MEMBERS

(75) Inventor: Gerald Thomas Lioy, Penfield, NY (US)

(73) Assignee: Xerox Corporation, Norwalk, CO (US)

( * ) Notice: Subject to any disclaimer, the term of this patent is extended or adjusted under 35 U.S.C. 154(b) by 436 days.

(21) Appl. No.: 12/099,357

(22) Filed: Apr. 8, 2008

(65) Prior Publication Data

US 2009/0252538 A1 Oct. 8, 2009

(51) Int. Cl.
*G03G 15/08* (2006.01)
*G03G 15/09* (2006.01)

(52) U.S. Cl. ..... 399/254; 399/269; 399/284

(58) Field of Classification Search ..... 399/254, 399/260, 264, 269, 284
See application file for complete search history.

(56) References Cited

U.S. PATENT DOCUMENTS 4,942,431 A * 7/1990 Tada ..... 399/58
4,985,823 A * 1/1991 Tada et al. ..... 399/59
5,576,814 A * 11/1996 Nishimura et al. ..... 399/276
5,604,573 A * 2/1997 Endo et al. ..... 399/55
5,612,770 A * 3/1997 Bandai et al. ..... 399/254
6,505,832 B2 1/2003 Moore et al.
2002/0071697 A1* 6/2002 Fujimoto ..... 399/254
2006/0045575 A1* 3/2006 Mabuchi et al. ..... 399/267
2006/0204283 A1* 9/2006 Yasuda ..... 399/254
2007/0019994 A1* 1/2007 Choi ..... 399/254
2007/0025773 A1* 2/2007 Tateyama et al. ..... 399/254
2007/0104518 A1* 5/2007 Ohyama ..... 399/284

* cited by examiner

*Primary Examiner*—David M Gray
*Assistant Examiner*—Rodney Bonnette
(74) *Attorney, Agent, or Firm*—Ronald E. Prass, Jr.; Prass LLP

(57) ABSTRACT

Developer units for supplying developer material to a photoconductive member is disclosed and may include a magnetic roll having an outer surface, a first auger adjacent the magnetic roll being rotatable to convey the developer material to the outer surface of the magnetic roll, a second auger disposed below the first auger, a first trim blade disposed at a first angular position about the outer surface of the magnetic roll for leveling the developer material on the outer surface during rotation of the magnetic roll, and a second trim blade disposed at a second angular position about the outer surface of the magnetic roll for leveling the developer material on the outer surface that has been leveled by the first trim blade during rotation of the magnetic roll, the magnetic roll being rotatable to supply the developer material leveled by the second trim blade to the photoconductive member.

17 Claims, 3 Drawing Sheets

DEVELOPER UNITS, ELECTROPHOTOGRAPHIC APPARATUSES AND METHODS OF SUPPLYING DEVELOPER MATERIAL TO PHOTOCONDUCTIVE MEMBERS

BACKGROUND

Developer units, electrophotographic apparatuses, and methods of supplying developer material to photoconductive members are disclosed.

In a typical electrophotographic process, a photoconductive member with a photoconductive layer is charged. The photoconductive member is exposed to selectively discharge areas of the photoconductive layer, while maintaining charge in other areas corresponding to image areas of an original document. This process records an electrostatic latent image of the original document on the photoconductive layer.

The latent image is developed by depositing developer material containing toner on the photoconductive layer using a developer housing structure. The toner is attracted to the charged image areas to produce a visible toner image on the photoconductive layer. The toner image is then transferred from the photoconductive member to a copy sheet. The toner is subjected to heat and pressure conditions effective to permanently affix the toner image to the copy sheet.

In developer housing structures that are designed for trimming developer material at the top of a magnetic roll, the trim position is typically located within about 135° of the pick-up position with respect to the outer surface of the magnetic roll. In such "top trim" developer units, the magnetic characteristics of the portion of the magnetic roll between developer material pick-up and trim positions can be optimized for trimming purposes.

It would be desirable to provide developer units suitable for use in electrophotographic apparatuses that are not constructed for trimming the developer material at the top of the magnetic roll, and can supply developer material to photoconductive members uniformly and at a desired rate.

SUMMARY

Developer units, electrophotograhic apparatuses including the developer units, and methods of supplying developer material to photoconductive members in electrophotographic apparatuses are provided. An embodiment of a developer unit for supplying a developer material to a photoconductive member is provided, which comprises a magnetic roll having an outer surface; a first auger adjacent the magnetic roll, the first auger being rotatable to convey the developer material to the outer surface of the magnetic roll; a second auger disposed below the first auger; a first trim blade disposed at a first angular position about the outer surface of the magnetic roll, the first trim blade adapted for leveling the developer material on the outer surface during rotation of the magnetic roll; and a second trim blade disposed at a second angular position about the outer surface of the magnetic roll, the second trim blade adapted for further leveling the developer material on the outer surface that has been leveled by the first trim blade during rotation of the magnetic roll; wherein the magnetic roll is rotatable to supply the developer material that has been leveled by the second trim blade to the photoconductive member.

DRAWINGS

DETAILED DESCRIPTION

Figure 1:
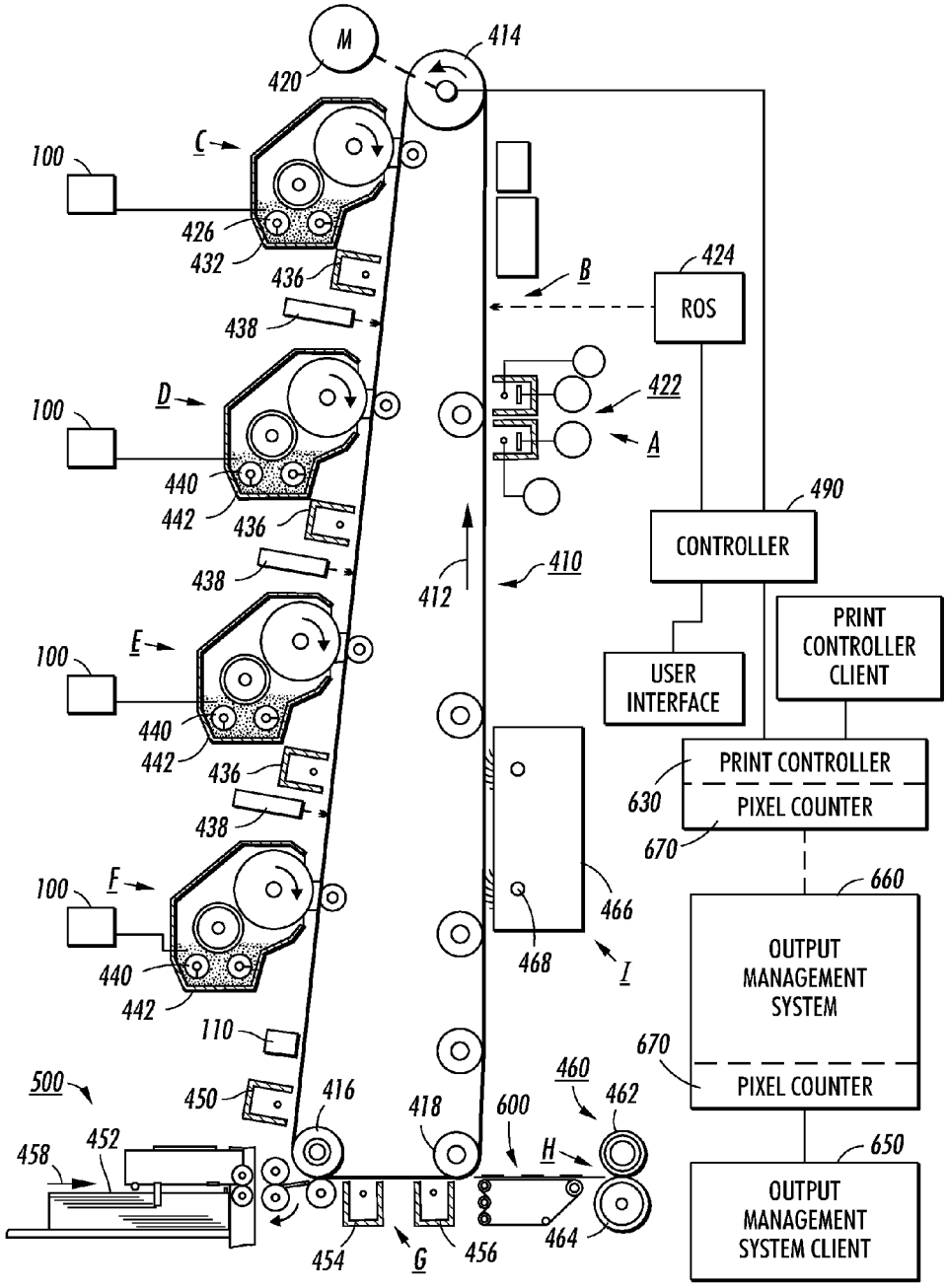
FIG. 1 illustrates an embodiment of an electrophotographic apparatus.

The disclosed embodiments include a developer unit for supplying a developer material to a photoconductive member. The developer unit includes a magnetic roll having an outer surface; a first auger adjacent the magnetic roll, the first auger being rotatable to convey the developer material to the outer surface of the magnetic roll; a second auger disposed below the first auger; a first trim blade disposed at a first angular position about the outer surface of the magnetic roll, the first trim blade adapted for leveling the developer material on the outer surface during rotation of the magnetic roll; and a second trim blade disposed at a second angular position about the outer surface of the magnetic roll, the second trim blade adapted for further leveling the developer material on the outer surface that has been leveled by the first trim blade during rotation of the magnetic roll. The magnetic roll is rotatable to supply the developer material that has been leveled by the second trim blade to the photoconductive member.

The disclosed embodiments further include a developer unit for supplying a developer material to a photoconductive member, which includes a first magnetic roll having an outer surface; a second magnetic roll disposed above the first magnetic roll; a first auger adjacent the first magnetic roll, the first auger being rotatable to convey the developer material to the outer surface of the first magnetic roll at a pick-up position; a second auger disposed below the first auger; a first trim blade disposed at a first angular position about the outer surface of the first magnetic roll, the first trim blade adapted for leveling the developer material on the outer surface during rotation of the first magnetic roll; and a second trim blade disposed at a second angular position about the outer surface of the first magnetic roll, the second trim blade adapted for further leveling the developer material on the outer surface that has been leveled by the first trim blade during the rotation of the first magnetic roll. The first magnetic roll is rotatable to supply the developer material that has been leveled by the second trim blade to the photoconductive member and the second magnetic roll.

The disclosed embodiments further include a method of supplying a developer material to a photoconductive member in an electrophotographic apparatus. The method includes supplying the developer material with a first auger to an outer surface of a first magnetic roll; leveling the developer material on the outer surface with a first trim blade at a first angular position during rotation of the first magnetic roll; rotating the first magnetic roll to move the developer material that has been leveled by the first trim blade to a second angular position angularly spaced about the outer surface from the first angular position; further leveling the developer material on the outer surface that has been leveled by the first trim blade with a second trim blade at the second angular position; and further rotating the first magnetic roll to transport the developer material from the second angular position to the photoconductive member.

FIG. 1 illustrates an exemplary digital imaging system in which embodiments of the disclosed developer unit can be used. Such digital imaging systems are disclosed in U.S. Pat. No. 6,505,832, which is hereby incorporated by reference in its entirety. The imaging system is used to produce an image, such as a color image output in a single pass of a photoreceptor belt. It will be understood, however, that embodiments of the developer unit can be used in other systems. It is intended to cover all alternatives, modifications and equivalents as may be included within the spirit and scope of the invention as defined by the appended claims, including, for example, a multiple-pass color process system, a single- or multiple-pass highlight color system, or a black and white printing system.

As shown in FIG. 1, an output management system 660 can supply printing jobs to a print controller 630. Printing jobs can be submitted from the output management system client 650 to the output management system 660. A pixel counter 670 is incorporated into the output management system 660 to count the number of pixels to be imaged with toner on each sheet or page of the job, for each color. The pixel count information is stored in the memory of the output management system 660. The output management system 660 submits job control information, including the pixel count data, and the printing job to the print controller 630. Job control information, including the pixel count data and digital image data are communicated from the print controller 630 to the controller 490.

The printing system can use a charge retentive surface in the form of an active matrix (AMAT) photoreceptor belt 410 supported for movement in the direction of arrow 412, for advancing sequentially through the various xerographic process stations. The photoreceptor belt 410 is provided on a drive roll 414, tension roll 416 and fixed roll 418. The drive roll 414 is operatively connected to a drive motor 420 for moving the belt through the xerographic stations.

During the printing process, a portion of the photoreceptor belt 410 passes through a charging station A including a corona generating device 422, which charges the photoconductive surface of photoreceptor belt 410 to a relatively high, substantially uniform potential.

Next, the charged portion of the photoconductive surface of the photoreceptor belt 410 is advanced through an imaging/exposure station B. At imaging/exposure station B, the controller 490 receives the image signals from the print controller 630 representing the desired output image, and processes these signals to convert them to signals transmitted to a laser-based output scanning device, which causes the charged surface to be discharged in accordance with the output from the scanning device. In the exemplary system, the scanning device is a laser raster output scanner (ROS) 424. Alternatively, the scanning device can be light-emitting diode (LED) array or the like.

The photoreceptor belt 410, which is initially charged to a voltage V0, undergoes dark decay to a level equal to about −500 volts. When exposed at the exposure station B, the photoreceptor belt 410 is discharged to a voltage level equal to about −50 volts. Thus, after exposure, the photoreceptor belt 410 contains a monopolar voltage profile of high and low voltages, the high voltages corresponding to charged areas and the low voltages corresponding to discharged or developed areas.

At a first development station C, comprising a developer structure 432 utilizing a hybrid development system, a developer roll (or "donor roll") is powered by two developer fields (potentials across an air gap). The first field is the AC field, which is used for toner cloud generation. The second field is the DC developer field, which is used to control the amount of developed toner mass 426 on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed (unfixed) image is then transported past a second charging device 436 where the photoreceptor belt 410 and previously developed toner image areas are recharged to a predetermined level.

A second exposure/imaging is performed by device 438 including a laser-based output structure, which selectively discharges the photoreceptor belt 410 on toned areas and/or bare areas, pursuant to the image to be developed with the second color toner. At this point of the process, the photoreceptor belt 410 contains toned and untoned areas at relatively high voltage levels, and toned and untoned areas at relatively low voltage levels. These low voltage areas represent image areas, which are developed using discharged area development (DAD). A negatively-charged, developer material 440 comprising color toner is employed. The toner is contained in a developer housing structure 442 disposed at a second developer station D and is transferred to the latent images on the photoreceptor belt 410 using a second developer system. A power supply (not shown) electrically biases the developer structure to a level effective to develop the discharged image areas with negatively charged toner particles. Further, a toner concentration sensor can be used to sense the toner concentration in the developer housing structure 442.

The above procedure is repeated for a third image for a third suitable color toner, such as magenta (station E), and for a fourth image and suitable color toner, such as cyan (station F). The exposure control scheme described below may be utilized for these subsequent imaging steps. In this manner, a full-color composite toner image is developed on the photoreceptor belt 410. In addition, at least one mass sensor 110 measures developed mass per unit area.

In case some toner charge is totally neutralized, or the polarity reversed, thereby causing the composite image developed on the photoreceptor belt 410 to include both positive and negative toner, a negative pre-transfer dicorotron member 450 is provided to condition the toner for effective transfer to a support sheet using positive corona discharge.

Subsequent to image development, a support sheet 452 (e.g., paper) is moved into contact with the toner images at transfer station G. The support sheet 452 is advanced to the transfer station G by a sheet feeding apparatus 500. The support sheet 452 is then brought into contact with the photoconductive surface of the photoreceptor belt 410 in a timed sequence so that the toner powder image developed on the photoreceptor belt 410 contacts the advancing support sheet 452 at the transfer station G.

The transfer station G includes a transfer dicorotron 454, which sprays positive ions onto the backside of the support sheet 452. The ions attract the negatively charged toner powder images from the photoreceptor belt 410 to the support sheet 452. A detack dicorotron 456 is provided for facilitating stripping of support sheets from the photoreceptor belt 410.

After transfer of the toner images, the support sheet continues to move, in the direction of arrow 458, onto a conveyor 600. The conveyor 600 advances the support sheet to a fusing station H. The fusing station H includes a fuser assembly 460, which is operable to permanently affix the transferred powder image to the support sheet 452. The fuser assembly 460 can comprise a heated fuser roll 462 and a pressure roll 464. The support sheet 452 passes between the fuser roll 462 and pressure roll 464 with the toner powder image contacting fuser roll 462, causing the toner powder images to be permanently affixed to the support sheet 452. After fusing, a chute (not shown) guides the advancing support sheet 452 to a catch tray, stacker, finisher or other output device (not shown), for subsequent removal from the printing apparatus by the operator. The fuser assembly 460 can be contained within a cassette, and can include additional elements not shown in FIG. 1, such as a belt around the fuser roll 462.

After the support sheet 452 is separated from the photoconductive surface of the photoreceptor belt 410, residual toner particles carried by the non-image areas on the photoconductive surface are removed from the photoconductive surface. These toner particles are removed at cleaning station I using, e.g., a cleaning brush or plural brush structure contained in a housing 466. The cleaning brushes 468 are engaged after the composite toner image is transferred to a support sheet.

The controller 490 is operable to regulate the various printer functions. The controller 490 can be a programmable controller operable to control printer functions described above. For example, the controller 490 can provide a comparison count of copy sheets, the number of documents being re-circulated, the number of copy sheets selected by the operator, time delays, jam corrections, and/or other selected information. The control of all of the exemplary systems described above can be accomplished by conventional control switch inputs from the printing machine consoles selected by an operator. Sheet path sensors or switches can be utilized to monitor the position of the document and support sheets.

Figure 2:
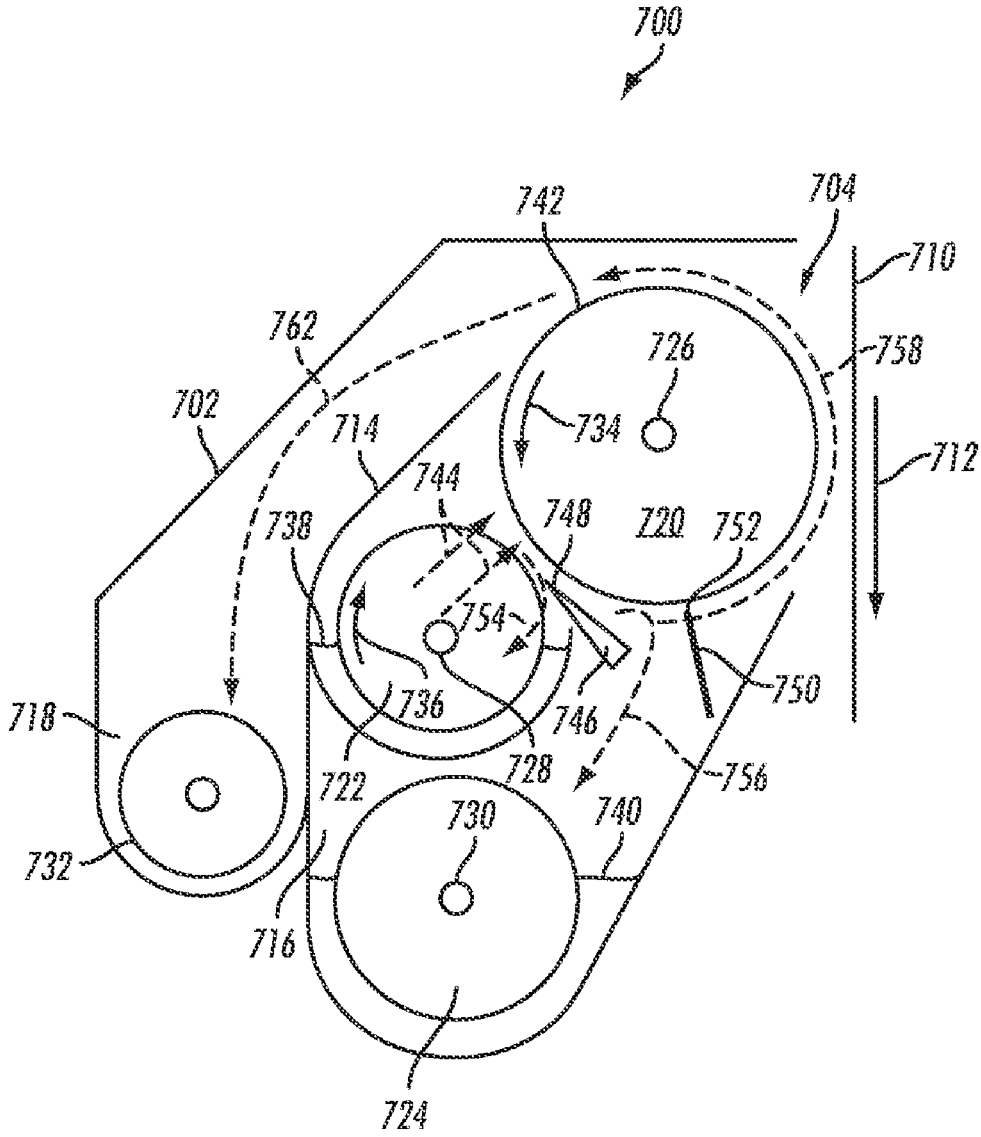
FIG. 2 illustrates an embodiment of the developer unit including a single magnetic roll.

FIG. 2 illustrates a developer unit 700 according to an embodiment. The developer unit 700 can be used, e.g., in the electrophotographic apparatus shown in FIG. 1 in place of one or more of the developer housing structures 442. The developer unit 700 includes a housing 702 with an opening 704. In the embodiment, a photoconductive member in the form of a photoreceptor belt 710 is disposed at the opening 704. The photoreceptor belt 710 moves in the direction of arrow 712 during operation of the electrophotographic apparatus in which the developer unit 700 is contained. During operation, developer material is supplied from the developer unit 700 to the photoreceptor belt 710. The developer material is a two-component developer material including toner and a magnetic carrier material.

The housing 702 of the developer unit 700 includes a wall 714 dividing the interior of the housing 702 into a first region 716 and an adjacent second region 718. A magnetic roll 720, first auger 722 and second auger 724 are disposed in the first region 716. The magnetic roll 720 is typically cylindrical shaped. The magnetic roll 720 includes a rotatable outer portion including an outer surface 742, which rotates around a stationary set of magnets. During operation, magnetic carrier material is picked up at certain locations along the circumference of the outer surface 742 and carrier magnetically to the desired location. The magnetic roll 720 has a longitudinal axis 726, the first auger 722 has a longitudinal axis 728, and the second auger 724 has a longitudinal axis 730. In the embodiment, the longitudinal axes 728, 730 of the first auger 722 and second auger 724, respectively, are disposed below, and laterally spaced from, the longitudinal axis 726 of the magnetic roll 720.

In the embodiment, the first auger 722 functions as a pick-up auger, and the second auger 724 functions as a mixing auger. The first auger 722 and second auger 724 are arranged in a vertical configuration in the developer unit 700. In the depicted orientation of the developer unit 700, the longitudinal axes 728, 730 of the first auger 722 and second auger 724, respectively, can lie along a common vertical plane, or can be laterally off-set from each other.

A third auger 732 is disposed in the second region 718 of the housing 702. In the embodiment, the third auger 732 functions as a return auger for the developer material.

As indicated by arrows 734, 736, the magnetic roll 720 and the first auger 722 are driven (e.g., by respective motors (not shown)) to rotate in counter-clockwise and clockwise directions, respectively, during operation of the developer unit 700.

The first auger 722 is immersed in a supply of the developer material 738. Rotation of the first auger 722 and magnetic roll 720 causes the developer material 738 to be loaded onto the outer surface 742 of the magnetic roll 720 at a pick-up position, as indicated by arrows 744. The developer material on the outer surface 742 is magnetically transported by rotation of the magnetic roll 720 from the pick-up position 744 to a first trim blade 746. As shown, the first trim blade 746 is angularly spaced from the pick-up position 744 and disposed at a first angular position about the outer surface 742 of the magnetic roll 720. The location of the first angular position with respect to the outer surface 742 of the magnetic roll 720 can be defined, e.g., by the location of the tip 748 of the first trim blade 746. At least a portion of the first trim blade 746 including the tip 748 is located between the outer surface 742 and the first auger 722. The first trim blade 746 functions in the developer unit 700 to level the developer material on the outer surface 742 during rotation of the magnetic roll 720. The first trim blade 746 is made of a suitable non-magnetic material. The first trim blade 746 can have any suitable size and cross-sectional shape, such as the illustrated triangular cross-section.

The developer unit 700 further includes a second trim blade 750 disposed below the magnetic roll 720 in the illustrated vertical auger architecture. The second trim blade 750 is made of a suitable non-magnetic material, and can have any suitable size and cross-sectional shape, such as the illustrated rectangular cross-section. The arrangement of the first trim blade 746 and second trim blade 750 below the magnetic roll 720 can be referred to as a "bottom trim" arrangement. The first blade 746 is provided in the developer unit 700 to address the problem of supplying a uniform rate of developer material to the second trim blade 750 in a bottom trim developer unit arrangement, as shown.

The illustrated vertical auger arrangement of the developer unit 700 is desirable for performing bottom trimming of the developer material. That is, this arrangement provides for a robust method to both supply developer material to the magnetic roll 720 at the pick-up position 744 and to collect/return excess developer material from the first trim blade 746, within the space constraints of the bottom trim arrangement. The space constraints found in the bottom trim developer unit 700 include a small angular separation (e.g., about 45°) between the pick-up position 744 and the second angular position of the second trim blade 750. The location of the second angular position with respect to the outer surface 742 of the magnetic roll 720 can be defined, e.g., by the location of the tip 752 of the second trim blade 750 about the outer surface 742. With the space constraints of this arrangement, it may not be possible to provide suitable magnetic characteristics in the region of the magnetic roll 720 between the pick-up position 744 and the second trim blade 750. In the illustrated developer unit 700, by providing the first trim blade 746 between the pick-up position 744 and the second trim blade 750 to "pre-trim" the developer material, the amount of the developer material that is supplied to the second trim blade 750 can be controlled to a desired amount despite the size constraints of the vertical auger architecture.

In the developer unit 700, the first trim blade 746 levels (or "pre-trims") the developer material on the outer surface 742 of the magnetic roll 720 to control the amount of developer material on the outer surface 742, to thereby control the rate of supplying the developer material to the second trim blade 750 to a desired rate. The first trim blade 746 can level the developer material on the magnetic roll 720 down to a substantially constant thickness or mass before the developer material reaches the second trim blade 750. For example, the first trim blade 746 can be configured and positioned relative to the outer surface 742 to remove about 50% to about 75% (on a mass or thickness basis) of the amount of developer material on the outer surface 742 that is picked up at the pick-up position 744 by the magnetic roll 720. The developer material can be abrasive to materials forming the outer surface 742 and the second trim blade 750. The first trim blade 746 is able to prevent an excessive amount of developer material being supplied to the second trim blade 750. Such excessive developer material can result in undesirably-high power consumption for driving the magnetic roll 720, rapid wear of the outer surface 742 of the magnetic roll 720 (and consequently a short service life of the magnetic roll 720), and/or starvation of the first auger 722. The lower limit failure modes for the developer unit 700 include starvation and non-uniform loading of the magnetic roll, where the developer mass-on-roll (MOR) blanket thickness is too low and/or not sufficiently uniform. By controlling the supply of the developer material to the second trim blade 750, the occurrence of these lower limit failure modes can be reduced, and desirably prevented, in the developer unit 700.

The second trim blade 750 can be angularly spaced in the clockwise direction about the outer surface 742 of the magnetic roll 720 from the first trim blade 750 by an angle of, e.g., about 15° to about 30° about the outer surface 742. The second trim blade 750 functions in the developer unit 700 to level the developer material on the outer surface 742 of the magnetic roll 720 that has been leveled (or "pre-leveled") by the first trim blade 746 during rotation of the magnetic roll 720.

Continued rotation of the magnetic roll 720 supplies the developer material that has been leveled by the second trim blade 750 to the photoreceptor belt 710.

After the magnetic roll 720 has conveyed the developer material to the photoreceptor belt 710 as depicted by arrow 758, residual developer material can be magnetically separated from the outer surface 742 of the magnetic roll 720, as depicted by arrow 762. The third auger 732 is provided in the developer unit 700 to convey the residual developer material removed from the magnetic roll 720 to a mixing region (not shown) in the developer unit.

In the developer unit 700, the amount of the developer material (on a thickness or mass basis) that is transported by the magnetic roll 720 to the second trim blade 750 is controlled by providing the first trim blade 746 at the first angular position about the outer surface 743 of the magnetic roll 720. The first trim blade 746 is typically stationary. The tip 748 of the first trim blade 746 is spaced a first distance from the outer surface 742 of the magnetic roll 720. The first distance is typically fixed. The first trim blade 746 is adapted to level the developer material on the outer surface 742 to a first maximum thickness. That is, when the depth (thickness) of the developer material on the outer surface 742 is greater than the first distance, the first trim blade 746 removes developer material from the outer surface 742 of the magnetic roll. The second auger 724 is immersed in a supply of the developer material 740. The removed developer material is directed into the supply of the developer material 738 and the supply of the developer material 740, as indicated by arrows 754, 756, respectively.

The second trim blade 750 is typically stationary. The tip 752 of the second trim blade 750 is located closer to the outer surface 742 of the magnetic roll than the tip 748 of the first trim blade 746. The second trim blade 750 is adapted to level the developer material on the outer surface 742 to a second maximum thickness, which is smaller than the first maximum thickness to which the developer material has been leveled by the first trim blade 746 (i.e., when the thickness of the developer material supplied to the outer surface 742 at the pick-up position 744 exceeds the spacing between the tip 748 of the first trim blade 746 and the outer surface 742). That is, when the depth of the developer material on the outer surface 742 that reaches the tip 752 exceeds the spacing between the tip 752 and the outer surface 742, the second trim blade 750 removes developer material from the outer surface 742. This removed developer material is directed into the developer material supply 740.

The tip 748 of the first trim blade 746 and the tip 752 of the second trim blade 750 can each extend in a direction parallel to the longitudinal axis 726 of the magnetic roll 720. The tip 748 and the tip 752 can each extend along substantially the entire length of the magnetic roll 720. Desirably, the tip 748 and the tip 752 can level the developer material to uniform first and second maximum thicknesses, respectively, along the length of the magnetic roll 720.

Controlling the supply of the developer material to the second trim blade 750 by providing the first trim blade 746 between the pick-up position 744 and the second trim blade 750 can improve aspects of the performance of the developer unit 700, including the quality of images produced with the developer unit 700. For example, controlling the supply of the developer material to the second trim blade 750 can reduce the amount of power needed for driving the magnetic roll 720; reduce wear of the outer portion (or shell) of the magnetic roll (including outer surface 742); reduce or desirably avoid starvation of the first auger 722; increase MOR uniformity; and increase sump mass latitude (e.g., allow for increased variability in the orientation of the developer unit 700 within an electrophotographic apparatus).

The gap and tolerance specifications for the first trim blade 746 can be, e.g., two, three or even more times greater than those for the second trim blade 750. Accordingly, the first trim blade 746 can be constructed such that it does not significantly contribute to drive power requirements or part wear rates in the developer unit 700.

It is contemplated that the development unit 700 including a trim blade for pre-trimming of developer material can be used in various electrophotographic systems, such as color and monochrome systems, different toner designs, and different carrier designs.

Figure 3:
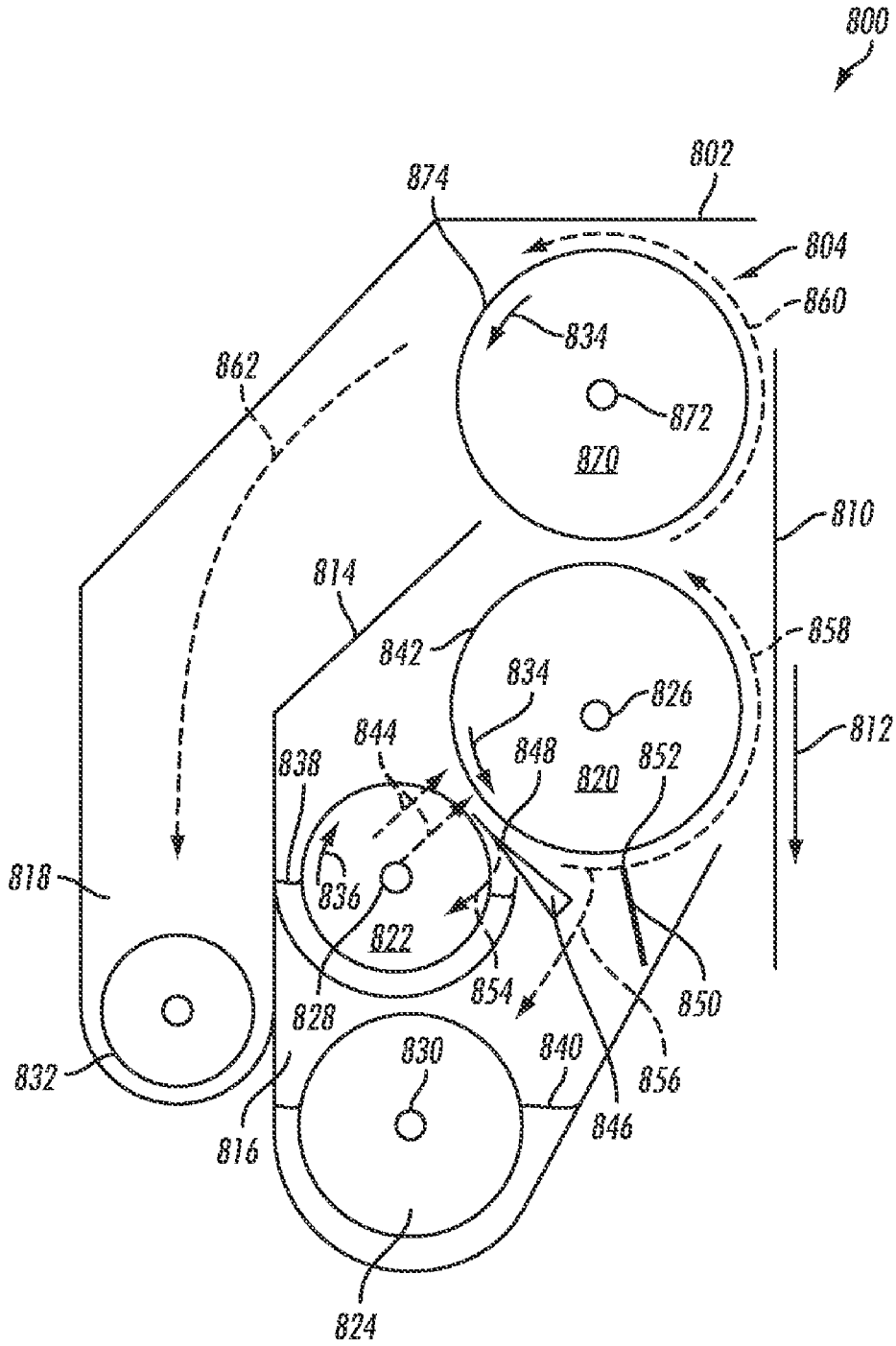
FIG. 3 illustrates another embodiment of the developer unit including two magnetic rolls.

FIG. 3 illustrates a developer unit 800 in accordance with another embodiment. The developer unit 800 is a dual magnetic roll unit including a first magnetic roll 820 and a second magnetic roll 870. The first magnetic roll 820 and second magnetic roll 870 each include a rotatable outer portion having an outer surface 842, 874, respectively, which rotate around a stationary set of magnets. The illustrated developer unit 800 has a vertical architecture. The developer unit 800 can include the same components as those included in the developer unit shown in FIG. 2. The developer unit 800 also includes components operatively connected with the second magnetic roll 870.

As shown in FIG. 3, the developer unit 800 includes a housing 802 with an opening 804. A photoreceptor belt 810 is disposed at the opening 804. As indicated, the photoreceptor belt 810 moves in the direction of arrow 812 during operation of the electrophotographic apparatus in which the developer unit 800 is contained. Developer material is supplied from the developer unit 800 to the photoreceptor belt 810 during operation.

The housing 802 of the developer unit 800 includes a wall 814 dividing the interior of the housing into a first region 816 and an adjacent second region 818. A first magnetic roll 820, first auger 822 and second auger 824 are disposed in the first region 818. The first magnetic roll 820 is typically cylindrical shaped and has a longitudinal axis 826. The first auger 822 has a longitudinal axis 828, and the second auger 824 has a longitudinal axis 830. In the embodiment, the longitudinal axes 828, 830 of the first auger 822 and second auger 824, respectively, are disposed below, and laterally spaced from, the longitudinal axis 826 of the first magnetic roll 820.

In the embodiment, the second magnetic roll 870 is disposed above the first magnetic roll 820. The second magnetic roll 870 is typically cylindrical shaped and has a longitudinal axis 872. The longitudinal axes 826, 872 of the first magnetic roll 820 and the second magnetic roll 870, respectively, can lie along a common vertical plane, as shown, or be laterally off-set from each other.

In the embodiment, the first auger 822 functions as a pick-up auger, and the second auger 824 functions as a mixing auger. The longitudinal axes 828, 830 of the first auger 822 and second auger 824, respectively, can lie along a common vertical plane, or be laterally off-set from each other.

A third auger 832 is disposed in the second region 818. In the embodiment, the third auger 832 functions as a return auger for the developer material.

As indicated by arrow 836, the first auger 822 is driven (by a motor (not shown)) to rotate in the clockwise direction and, as indicated by arrows 834, the first magnetic roll 820 and second magnetic roll 870 are driven (by at least one motor (not shown)) to rotate in the counter-clock-wise direction during operation of the developer unit 800. The first auger 822 is immersed in a supply of the developer material 838. The second auger 824 is immersed in a supply of the developer material 840.

Rotation of the first auger 822 and the first magnetic roll 820 causes the developer material to be loaded onto the outer surface 842 of the first magnetic roll 820 at a pick-up position indicated by arrows 844. The developer material on the outer surface 842 is magnetically transported by rotation of the first magnetic roll 820 from the pick-up position to a first trim blade 846 having a tip 848. The first trim blade 846 is disposed at a first angular position, which is angularly spaced from the pick-up position about the outer surface 842 of the first magnetic roll 820. The location of the first angular position with respect to the outer surface 842 of the magnetic roll 820 can be defined, e.g., by the location of the tip 848 of the first trim blade 846 about the outer surface 842. At least a portion of the first trim blade 846 including the tip 848 is located between the outer surface 842 and the first auger 822. The first trim blade 846 is typically stationary. The first trim blade 846 is provided in the developer unit 800 to level the developer material on the outer surface 842 of the first magnetic roll 820 during its rotation, by removing developer material from the outer surface 842. The removed developer material is directed into the supply of the developer material 838 and the supply of the developer material 840, as indicated by arrows 854, 856, respectively.

The developer unit 800 further includes a second trim blade 850 having a tip 852. The second trim blade 850 is disposed below the first magnetic roll 820 in the "bottom trim" arrangement. The first magnetic roll 820 has a longitudinal axis 826, and the tip 848 of the first trim blade 846 and the tip 852 of the second trim blade 850 can each extend in a direction parallel to the longitudinal axis 826 of the first magnetic roll 820. The tip 848 and the tip 852 can each extend along substantially the entire length of the first magnetic roll 820. Desirably, the tip 848 and the tip 852 can level the developer material to uniform first and second maximum thicknesses, respectively, along the length of the magnetic roll 820.

The first trim blade 846 is provided in the developer unit 800 to address the problem of supplying a uniform rate of the developer material to the second trim blade 850 in the bottom-trim arrangement. The first trim blade 846 is incorporated within the vertical auger architecture. The second trim blade 850 is disposed at a second angular position about the outer surface 842 of the first magnetic roll 820, and is angularly spaced in the clockwise direction about the outer surface 842 from the first trim blade 846. For example, the second trim blade 850 can be angularly spaced by an angle of, e.g., about 15° to about 30° about the outer surface 842 from the first trim blade 846. The second trim blade 850 is typically stationary.

In the developer unit, the amount of the developer material (i.e., thickness or mass) that is transported by the first magnetic roll 820 to the second trim blade 850 is controlled by providing the first trim blade 846 at the first angular position about the outer surface 842 of the first magnetic roll 820. The amount of developer material supplied to the second trim blade 850 can be controlled despite the size constrains imposed by the vertical auger architecture. The first trim blade 846 levels (or pre-trims) the developer material on the outer surface 842 of the first magnetic roll 820 to control the rate of supplying the developer material to the second trim blade 850 to a desired rate.

The first trim blade 846 can meter the developer material on the first magnetic roll 820 down to a substantially constant thickness or mass before the developer material reaches the second trim blade 850. The tip 848 of the first trim blade 846 is configured and spaced from the outer surface 842 of the first magnetic roll 820 by a first distance to level the developer material on the outer surface 842 to a first maximum thickness. That is, when the depth (thickness) of the developer material on the outer surface 842 of the first magnetic roll 820 is greater than the first distance, the first trim blade 846 removes developer material from the outer surface 842 so as to level the developer material.

The second trim blade 850 levels the developer material on the outer surface 842 of the first magnetic roll 820 that has been leveled (or pre-leveled) by the first trim blade 846 during rotation of the first magnetic roll 820 (i.e., when the thickness of the developer material supplied to the outer surface 842 at the pick-up position 844 exceeds the spacing between the tip 848 of the first trim blade 846 and the outer surface 842). The tip 852 of the second trim blade 850 is spaced from the outer surface 842 by a smaller distance than the tip 748 of the first trim blade 746. The second trim blade 850 is configured to level the developer material on the outer surface 842 to a second maximum thickness, which is smaller than the first maximum thickness. That is, when the depth of the developer material on the outer surface 842 that reaches the tip 852 is greater than the spacing between the tip 852 and the outer surface 842, the second trim blade 850 removes developer material from the outer surface 842 so as to level the developer material. The second trim blade 850 removes developer material from the outer surface 842 of the first magnetic roll 820 and directs the removed developer material into the supply of the developer material 840.

Continued rotation of the first magnetic roll 820 supplies the developer material that has been leveled by the second trim blade 850 to the photoreceptor belt 810 and to the second magnetic roll 870, as indicated by arrow 858. The transfer of the developer material from the first magnetic roll 820 to the second magnetic roll 870 is by magnetic transfer. Desirably, the developer material is substantially uniform in thickness on the second magnetic roll 870. The second magnetic roll 870 also supplies the developer material to the photoreceptor belt 810, as indicated by arrow 860.

After the second magnetic roll 870 has conveyed the developer material to the photoreceptor belt 810, residual developer material can be magnetically separated from the outer surface 874 of the second magnetic roll 870. The third auger 832 is provided in the developer unit 800 to convey the residual developer material removed from the second magnetic roll 870, as indicated by arrow 862, to a mixing region (not shown) in the developer unit 800.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A developer unit for supplying a developer material to a photoconductive member, comprising:

a magnetic roll having an outer surface;

a first auger adjacent the magnetic roll, the first auger being rotatable to convey the developer material to the outer surface of the magnetic roll, the first auger being partially immersed in a first supply of the developer material;

a second auger disposed below the first auger, the second auger being partially immersed in a second supply of the developer material;

a first trim blade disposed at a first angular position about the outer surface of the magnetic roll, the first trim blade being adapted for leveling the developer material on the outer surface during rotation of the magnetic roll and configured to remove developer material from the outer surface of the magnetic roll and direct the removed developer material into the first supply and second supply of the developer material; and a second trim blade disposed at a second angular position about the outer surface of the magnetic roll, the second trim blade being adapted for further leveling the developer material on the outer surface that has been leveled by the first trim blade during rotation of the magnetic roll and configured to remove developer material from the outer surface of the magnetic roll and direct the removed developer material into the second supply of the developer material;

wherein the magnetic roll is rotatable to supply the developer material that has been leveled by the second trim blade to the photoconductive member.

2. The developer unit of claim 1, wherein:

the magnetic roll has a longitudinal axis;

the first auger has a longitudinal axis disposed below, and laterally spaced from, the longitudinal axis of the magnetic roll;

the first trim blade is disposed between the first auger and the magnetic roll; and the second trim blade is disposed below the magnetic roll and angularly spaced about the outer surface of the magnetic roll from the first trim blade.

3. The developer unit of claim 1, further comprising:

a housing;

a first region inside of the housing containing the first and second augers;

a second region inside of the housing and separated from the first region by a wall; and a third auger disposed in the second region for conveying, to a mixing region, developer material removed from the magnetic roll after the magnetic roll has conveyed the developer material to the photoconductive member.

4. The developer unit of claim 1, wherein:

the first trim blade includes a first tip spaced a first distance from the outer surface of the magnetic roll, the first trim blade adapted for leveling the developer material on the outer surface to a first maximum thickness; and the second trim blade includes a second tip spaced a second distance smaller than the first distance from the outer surface, the second trim blade adapted for leveling the developer material on the outer surface to a second maximum thickness smaller than the first maximum thickness.

5. The developer unit of claim 4, wherein:

the magnetic roll has a longitudinal axis; and the first tip and the second tip each extend in a direction parallel to the longitudinal axis of the magnetic roll.

6. An electrophotographic apparatus comprising at least one developer unit according to claim 1.

7. A developer unit for supplying a developer material to a photoconductive member, comprising:

a first magnetic roll having an outer surface;

a second magnetic roll disposed above the first magnetic roll;

a first auger adjacent the first magnetic roll, the first auger being rotatable to convey the developer material to the outer surface of the first magnetic roll at a pick-up position and is partially immersed in a first supply of the developer material;

a second auger disposed below the first auger and is partially immersed in a second supply of the developer material contained in a trough;

a first trim blade disposed at a first angular position about the outer surface of the first magnetic roll, the first trim blade being adapted for leveling the developer material on the outer surface during rotation of the first magnetic roll and configured to remove the developer material from the outer surface of the first magnetic roll and direct the removed developer material into the first supply and second supply of the developer material; and a second trim blade disposed at a second angular position about the outer surface of the first magnetic roll, the second trim blade being adapted for further leveling the developer material on the outer surface that has been leveled by the first trim blade during the rotation of the first magnetic roll and configured to remove the developer material from the outer surface of the first magnetic roll and direct the removed developer material into the second supply of the developer material;

wherein the first magnetic roll is rotatable to supply the developer material that has been leveled by the second trim blade to the photoconductive member and the second magnetic roll.

8. The developer unit of claim 7, wherein:

the first magnetic roll has a first longitudinal axis;

the second magnetic roll has a second longitudinal axis;

the first auger has a longitudinal axis disposed below, and laterally spaced from, the first longitudinal axis and the second longitudinal axis;

the first trim blade is disposed between the first auger and the outer surface of the first magnetic roll; and the second trim blade is disposed below the first magnetic roll and angularly spaced about the outer surface of the first magnetic roll from the first trim blade.

9. The developer unit of claim 7, further comprising:

a housing;

a first region inside of the housing containing the first and second augers;

a second region inside of the housing and separated from the first region by a wall; and a third auger disposed in the second region for conveying, to a mixing region, developer material removed from the second magnetic roll after the second magnetic roll has conveyed the developer material to the photoconductive member.

10. The developer unit of claim 7, wherein:

the first trim blade includes a first tip spaced by a first distance from the outer surface of the first magnetic roll, the first trim blade adapted for leveling the developer material on the outer surface to a first maximum thickness; and the second trim blade includes a second tip spaced by a second distance smaller than the first distance from the outer surface, the second trim blade adapted for leveling the developer material on the outer surface to a second maximum thickness smaller than the first maximum thickness.

11. The developer unit of claim 7, wherein:

the first magnetic roll has a first longitudinal axis; and the first tip and the second tip each extend in a direction parallel to the first longitudinal axis of the first magnetic roll.

12. An electrophotographic apparatus comprising at least one developer unit according to claim 7.

13. A method of supplying a developer material to a photoconductive member in an electrophotographic apparatus, comprising:

supplying the developer material with a first auger to an outer surface of a first magnetic roll;

leveling the developer material on the outer surface with a first trim blade at a first angular position during rotation of the first magnetic roll;

rotating the first magnetic roll to move the developer material that has been leveled by the first trim blade to a second angular position angularly spaced about the outer surface from the first angular position;

further leveling the developer material on the outer surface that has been leveled by the first trim blade with a second trim blade at the second angular position; and further rotating the first magnetic roll to transport the developer material from the second angular position to the photoconductive member, wherein the first auger is immersed in a first supply of the developer material, and a second auger is immersed in a second supply of the developer material contained in a trough, the developer material is removed from the outer surface of the first magnetic roll with the first trim blade and directing the removed developer material into the first supply and second supply of the developer material, and the developer material is removed from the outer surface of the first magnetic roll with the second trim blade and directing the removed developer material into the second supply of the developer material.

14. The method of claim 13, further comprising:

rotating the first magnetic roll to transport the developer material from the first magnetic roll to a second magnetic roll disposed above the first magnetic roll; and rotating the second magnetic roll to transport the developer material from the second magnetic roll to the photoconductive member.

15. The method of claim 14, wherein:

the first magnetic roll has a first longitudinal axis;

the second magnetic roll has a second longitudinal axis disposed above the first longitudinal axis;

the second auger has a longitudinal axis disposed below, and laterally spaced from, the first longitudinal axis and second longitudinal axis;

the first trim blade is disposed between the first auger and the first magnetic roll, the first trim blade including a first tip spaced by a first distance from the outer surface of the first magnetic roll, the first trim blade leveling the developer material on the outer surface to a first maximum thickness; and the second trim blade is disposed below the first magnetic roll and angularly spaced about the outer surface of the first magnetic roll from the first trim blade, the second trim blade including a second tip spaced by a second distance smaller than the first distance from the outer surface, the second trim blade further leveling the developer material on the outer surface to a second maximum thickness smaller than the first maximum thickness.

16. The method of claim 13, further comprising:

removing developer material from the second magnetic roll after the second magnetic roll has conveyed the developer material to the photoconductive member; and directing the developer material removed from the second magnetic roll to a mixing region.

17. The method of claim 13, wherein the photoconductive member is a photoreceptor belt.

* * * * *